US009309902B2

(12) United States Patent
Dammeyer et al.

(10) Patent No.: US 9,309,902 B2
(45) Date of Patent: Apr. 12, 2016

(54) WARM UP CYCLE FOR A MATERIALS HANDLING VEHICLE

(71) Applicants: Karl L. Dammeyer, St. Marys, OH (US); Nicholas D. Thobe, Chickasaw, OH (US); David J. Obringer, Minster, OH (US); Cole T. Steinbrunner, New Bremen, OH (US); Marc A. McClain, St. Marys, OH (US); Darrin R. Ihle, Sidney, OH (US)

(72) Inventors: Karl L. Dammeyer, St. Marys, OH (US); Nicholas D. Thobe, Chickasaw, OH (US); David J. Obringer, Minster, OH (US); Cole T. Steinbrunner, New Bremen, OH (US); Marc A. McClain, St. Marys, OH (US); Darrin R. Ihle, Sidney, OH (US)

(73) Assignee: Crown Equipment Corporation, New Bremen, OH (US)

( * ) Notice: Subject to any disclaimer, the term of this patent is extended or adjusted under 35 U.S.C. 154(b) by 461 days.

(21) Appl. No.: 13/734,070

(22) Filed: Jan. 4, 2013

(65) Prior Publication Data

US 2013/0183127 A1 Jul. 18, 2013

Related U.S. Application Data

(60) Provisional application No. 61/586,440, filed on Jan. 13, 2012.

(51) Int. Cl.

| | |
|---|---|
| ***B66F 9/075*** | (2006.01) |
| ***B66F 9/22*** | (2006.01) |
| ***F15B 21/04*** | (2006.01) |

(52) U.S. Cl.

CPC ..... *F15B 21/042* (2013.01); *B66F 9/075* (2013.01); *B66F 9/22* (2013.01)

(58) Field of Classification Search

CPC ..... F15B 21/042; F15B 2211/851
USPC ..... 187/288; 414/592
See application file for complete search history.

(56) References Cited

U.S. PATENT DOCUMENTS

| | | | | |
|---|---|---|---|---|
| 6,076,488 | A * | 6/2000 | Yamagishi | 123/41.12 |
| 6,349,882 | B1 * | 2/2002 | Kita et al. | 236/34 |
| 7,344,000 | B2 * | 3/2008 | Dammeyer et al. | 180/305 |
| 8,104,583 | B2 | 1/2012 | Rekow et al. | |
| 2006/0042240 | A1 | 3/2006 | Sporer et al. | |
| 2006/0150621 | A1 * | 7/2006 | Nakata et al. | 60/337 |
| 2010/0065377 | A1 | 3/2010 | Billger et al. | |
| 2011/0162447 | A1 * | 7/2011 | Kirk et al. | 73/168 |

(Continued)

FOREIGN PATENT DOCUMENTS

| | | |
|---|---|---|
| CN | 1312411 A | 9/2001 |
| CN | 1755565 A | 4/2006 |

(Continued)

OTHER PUBLICATIONS

Rupcic, Zoran; International Search Report and Written Opinion; International Application No. PCT/US2013/020253; Mar. 18, 2013; European Patent Office.

(Continued)

*Primary Examiner* — William E Dondero
*Assistant Examiner* — Diem Tran
(74) *Attorney, Agent, or Firm* — Stevens & Showalter, LLP

(57) ABSTRACT

A method for operating a materials handling vehicle includes activating the materials handling vehicle and performing a warm up cycle. During the warm up cycle, energy is provided to at least one valve within the materials handling vehicle so as to energize the valve without providing a working fluid to the valve. Providing energy to the at least one valve effects a heating of oil located within the at least one valve.

37 Claims, 8 Drawing Sheets

(56) References Cited

U.S. PATENT DOCUMENTS

| | | | | |
|---|---|---|---|---|
| 2012/0209478 | A1 | 8/2012 | Dammeyer et al. | |
| 2014/0193230 | A1* | 7/2014 | McWethy | 414/680 |

FOREIGN PATENT DOCUMENTS

| | | | |
|---|---|---|---|
| CN | 101379302 | A | 3/2009 |
| CN | 102116285 | A | 7/2011 |
| EP | 1985869 | A1 | 10/2008 |
| JP | 11229430 | A | 8/1999 |
| JP | 2000249111 | A | 9/2000 |
| JP | 2001182705 | A | 7/2001 |
| JP | 2003166502 | A | 6/2003 |

OTHER PUBLICATIONS

Wu, Hui; First Office Action; Chinese Patent Application No. 201380005109.8; Sep. 2, 2015; State Intellectual Property Office of the People's Republic of China.

Communication pursuant to Article 94(3) EPC; European Patent Application No. 13701138.3; Jul. 30, 2015; European Patent Office, Munich, Germany.

Machine Translation of Japanese Patent Application No. 2001182705; Jul. 6, 2001; obtained from the Japanese Patent Office; Tokyo, Japan.

Machine Translation of Japanese Patent Application No. 2003166502; Jun. 13, 2013; obtained from the Japanese Patent Office; Tokyo, Japan.

* cited by examiner

WARM UP CYCLE FOR A MATERIALS HANDLING VEHICLE

TECHNICAL FIELD

The present invention relates to a warm up cycle for use in a materials handling vehicle that warms one or more valves in a hydraulic circuit.

BACKGROUND OF THE INVENTION

Known materials handling vehicles include a power unit, a mast assembly, and a platform assembly that includes a fork carriage assembly coupled to the mast assembly for vertical movement relative to the power unit. The mast assembly and platform assembly may each include components that are controlled by a hydraulic working fluid, such as pressurized oil. Valves provided within hydraulic fluid circuits associated with the mast and platform assemblies may control the flow of the working fluid to the components for effecting various functions performed by the components, such as raising/lowering, traversing (also known as side shifting), and pivoting of the lift carriage assembly.

SUMMARY OF THE INVENTION

In accordance with a first aspect of the present invention, a method for operating a materials handling vehicle includes activating the materials handling vehicle and performing a warm up cycle. During the warm up cycle, energy is provided to at least one valve within the materials handling vehicle so as to energize the valve without providing a working fluid to the valve. Providing energy to the at least one valve effects a heating of oil located within the at least one valve.

The method may further comprise performing a power up cycle after activating the vehicle and before performing the warm up cycle, wherein the power up cycle comprises verifying the operability of at least one vehicle component.

The oil may comprise a residue oil for the at least one valve.

The method may further comprise checking a temperature of the working fluid, which may comprise a hydraulic fluid that is circulated within a hydraulic fluid circuit including the at least one valve for implementing one or more vehicle functions associated with the at least one valve. The energy may only be provided to the at least one valve if the temperature of the working fluid is determined to be below a threshold temperature, which may be equal to or less than about −10° Celsius. The working fluid may comprise a low temperature hydraulic oil.

The method may further comprise prompting an operator if the warm up cycle is to be performed and only performing the warm up cycle if the operator responds in the affirmative.

The method may further comprise disabling one or more vehicle functions prior to the warm up cycle, and enabling the one or more vehicle functions upon completion of the warm up cycle.

The at least one valve may comprise one of a solenoid-operated proportional valve and a solenoid-operated non-proportional valve.

The materials handling vehicle may comprise a base unit, a mast assembly coupled to the base unit, a carriage assembly coupled to the mast assembly for reciprocal movement along the mast assembly. The carriage assembly may comprise a fork carriage assembly.

Providing energy to at least one valve may comprise providing energy to at least one of the following: an auxiliary lower valve that controls the flow of the working fluid out of an auxiliary hoist piston/cylinder unit when a lowering command is being implemented; an auxiliary raise valve that controls the flow of the working fluid into the auxiliary hoist piston/cylinder unit when a raise command is being implemented; a traverse valve that controls the flow of the working fluid to and/or from a traverse motor when a traverse command is being implemented; a pivot valve that controls the flow of the working fluid to and/or from one or more pivot piston/cylinder units when a pivot command is being implemented; and a load handler valve that controls a pressure level within a hydraulic circuit in which the working fluid flows. Providing energy to at least one valve may also comprise providing energy to each of these valves. Further, energy may be selectively provided to each of these individual valves for a valve-specific time period.

The energy may be provided to the at least one valve during the warm up cycle for a predetermined time period, which may be from about three to about five minutes or may vary depending upon a determined initial temperature of the working fluid. Further, the method may also comprise displaying a time remaining until completion of the warm up cycle on a display of the vehicle.

Only a predetermined number of warm up cycles may be permitted to be performed by the vehicle in a given time interval. For example, two warm up cycles may be performed by the vehicle during every half hour time interval. Moreover, a warm up cycle may be considered to be performed if the warm up cycle is performed for a least a predefined portion of a predetermined time period in which energy is provided to the at least one valve during the warm up cycle.

Providing energy to the at least one valve may comprise providing electric current to the at least one valve.

In an alternative embodiment, a temperature of the at least one valve is determined and wherein energy is only provided to the at least one valve if the temperature of the valve is determined to be below a threshold temperature.

In accordance with a second aspect, a method for operating a materials handling vehicle comprises providing a materials handling vehicle, activating the materials handling vehicle, and performing a warm up cycle. The materials handling vehicle may comprise a base unit, a mast assembly coupled to the base unit, a carriage assembly coupled to the mast assembly for reciprocal movement along the mast assembly, and a hydraulic fluid circuit including at least one valve for implementing one or more vehicle functions. The warm up cycle comprises providing energy to the at least one valve within the materials handling vehicle so as to energize the at least one valve, wherein providing energy to the at least one valve effects a heating of oil located within the at least one valve.

The method may further comprise checking a temperature of a working fluid, the working fluid comprising a hydraulic fluid that is circulated during normal operation of the vehicle within a hydraulic fluid circuit including the at least one valve for implementing one or more vehicle functions associated with the at least one valve.

The method may further comprise disabling a pump motor during the warm up cycle, the pump motor effecting movement of a working fluid through the at least one valve during normal operation of the vehicle.

In accordance with a further aspect of the present invention, a materials handling vehicle is provided comprising: a hydraulic fluid circuit including at least one valve for implementing one or more vehicle functions; and a controller for performing a warm up cycle comprising providing energy to the at least one valve so as to energize the at least one valve, wherein providing energy to the at least one valve effects a heating of residue oil located within the at least one valve.

The vehicle may further comprise a base unit; a mast assembly coupled to the base unit; and a carriage assembly coupled to the mast assembly for reciprocal movement along the mast assembly.

The carriage assembly may comprise a fork carriage assembly.

The controller may determine a temperature of a working fluid. The working fluid may comprise a hydraulic fluid that is circulated during normal operation of the vehicle within the hydraulic fluid circuit.

The energy may only be provided to the at least one valve if the temperature of the working fluid is determined to be below a threshold temperature.

The controller may disable a pump motor during the warm up cycle, the pump motor effecting movement of a working fluid through the at least one valve during normal operation of the vehicle.

The at least one valve may comprise a solenoid-operated proportional valve.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
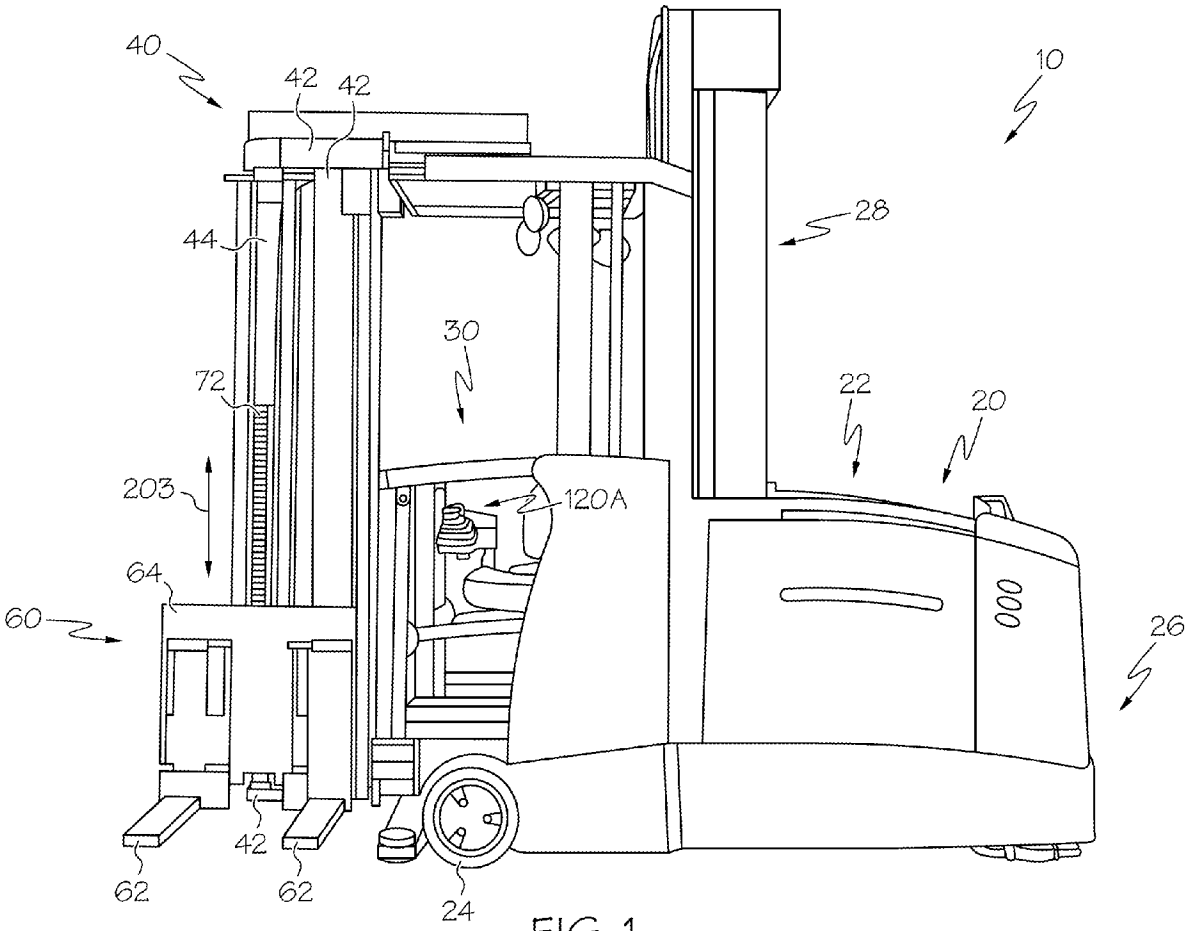
FIG. 1 is a side view of a materials handling vehicle constructed in accordance with the present invention.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Referring now to the drawings, and particularly to FIGS. 1-5, which illustrate a materials handling vehicle 10 constructed in accordance with the present invention. In the illustrated embodiment, the vehicle 10 comprises a turret stockpicker, such as the turret stockpicker disclosed in U.S. Pat. No. 7,344,000 entitled "ELECTRONICALLY CONTROLLED VALVE FOR A MATERIALS HANDLING VEHICLE," the entire disclosure of which is hereby incorporated by reference herein. The vehicle 10 includes a power unit 20 (also referred to herein as a first base unit), a platform assembly 30 (also referred to herein as a first carriage assembly) and a load handling assembly 40 (also referred to herein as a second base unit). The power unit 20 includes a power source, such as a battery unit 22, a pair of load wheels 24, see FIG. 5, positioned under the platform assembly 30, a steered wheel 25, see FIG. 4, positioned under the rear 26 of the power unit 20. The vehicle 10 further comprises a mast assembly 28 coupled to the power unit 20 on which the platform assembly 30 moves vertically. The mast assembly 28 comprises a first mast 28*a* fixedly coupled to the power unit 20, and a second mast 28*b* movably coupled to the first mast 28*a*, see FIGS. 4 and 5.

Figure 4:
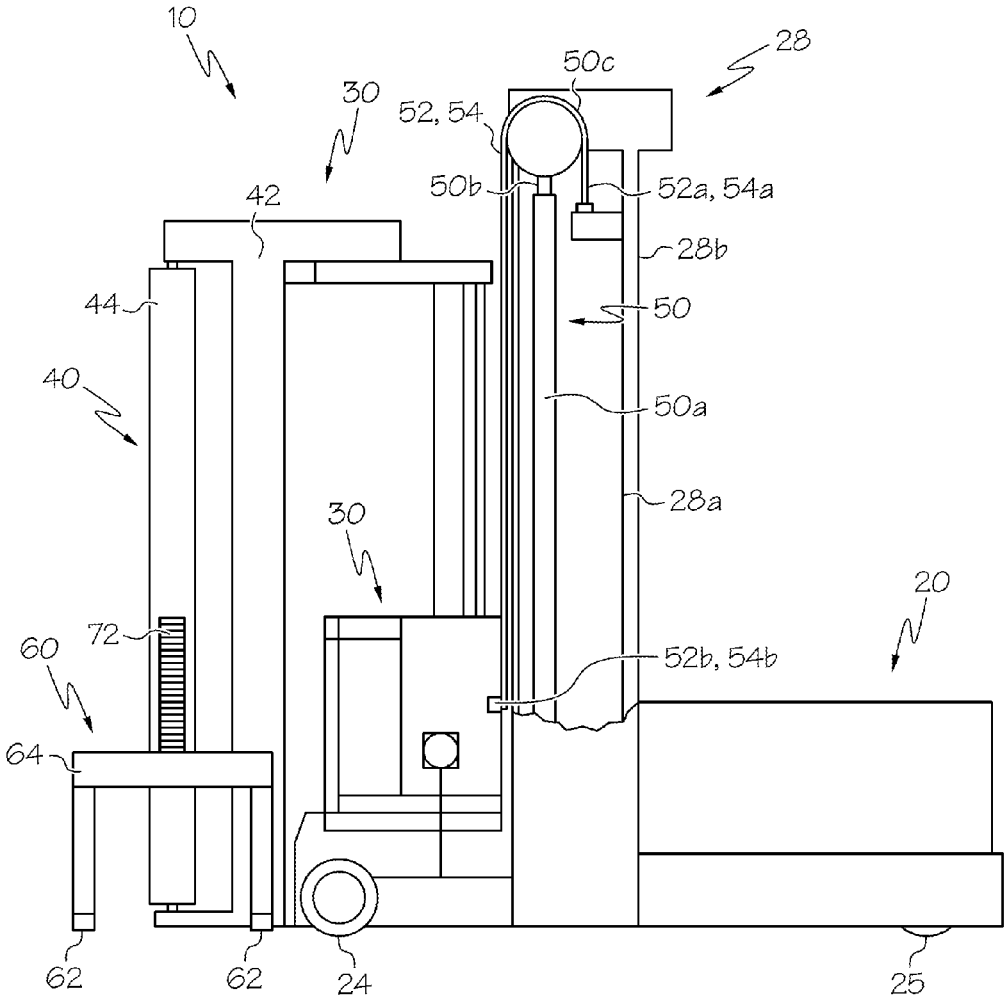
FIG. 4 is a schematic view of the vehicle of FIG. 1 illustrating the platform lift piston/cylinder unit.
Figure 5:
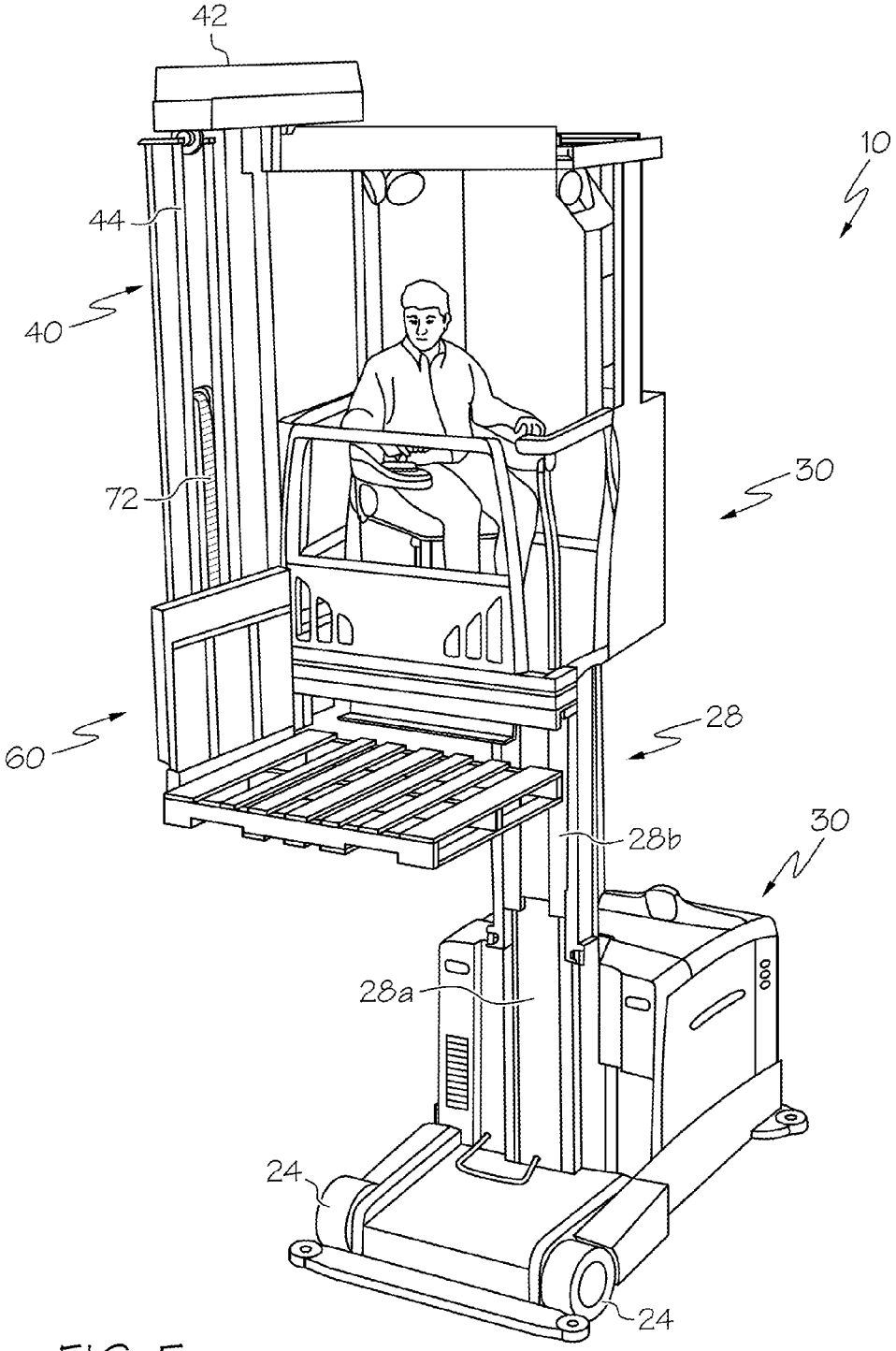
FIG. 5 is a perspective view of the vehicle illustrated in FIG. 1 with the platform assembly illustrated in an elevated position.

A mast piston/cylinder unit 50 is provided in the first mast 28*a* for effecting movement of the second mast 28*b* and the platform assembly 30 relative to the first mast 28*a* and the power unit 20, see FIG. 4. It is noted that the load handling assembly 40 is mounted to the platform assembly 30; hence, the load handling assembly 40 moves with the platform assembly 30. The cylinder 50*a* forming part of the piston/cylinder unit 50 is fixedly coupled to the power unit 20. The piston or ram 50*b* forming part of the unit 50 is fixedly coupled to the second mast 28*b* such that movement of the piston 50*b* effects movement of the second mast 28*b* relative to the first mast 28*a*. The piston 50*b* comprises a pulley 50*c* on its distal end, which engages a pair of chains 52 and 54. One unit of vertical movement of the piston 50*b* results in two units of vertical movement of the platform assembly 30. Each chain 52, 54 is fixedly coupled at a first end 52*a*, 54*a* to the first mast 28*a* and coupled at a second end 52*b*, 54*b* to the platform assembly 30. Hence, upward movement of the piston 50*b* relative to the cylinder 50*a* effects upward movement of the platform assembly 30 via the pulley 50*c* pushing upwardly against the chains 52, 54. Downward movement of the piston 50*b* effects downward movement of the platform assembly 30. Movement of the piston 50*b* also effects movement of the second mast 28*b*.

Figure 2:
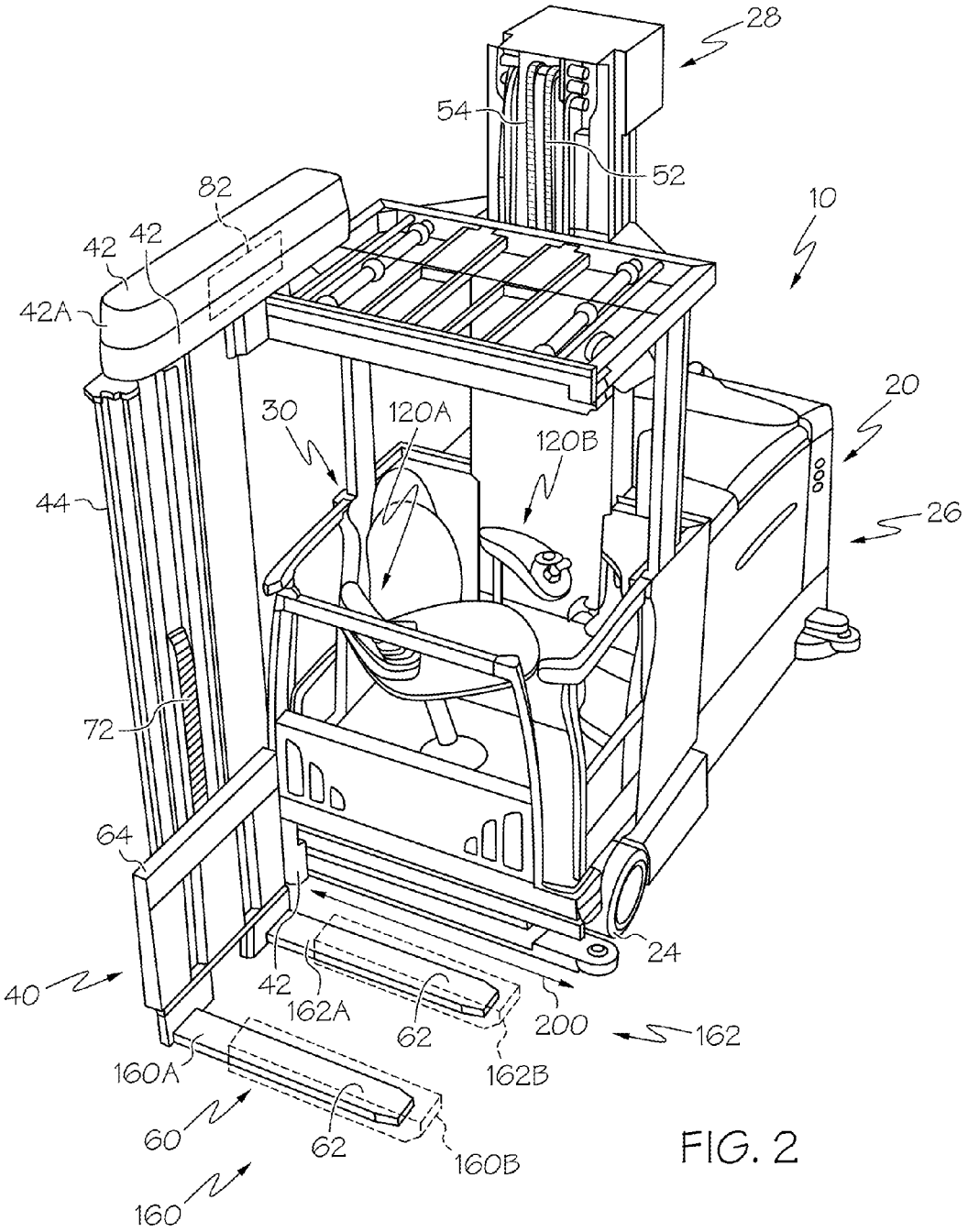
FIG. 2 is a perspective view of the vehicle illustrated in FIG. 1.
Figure 3:
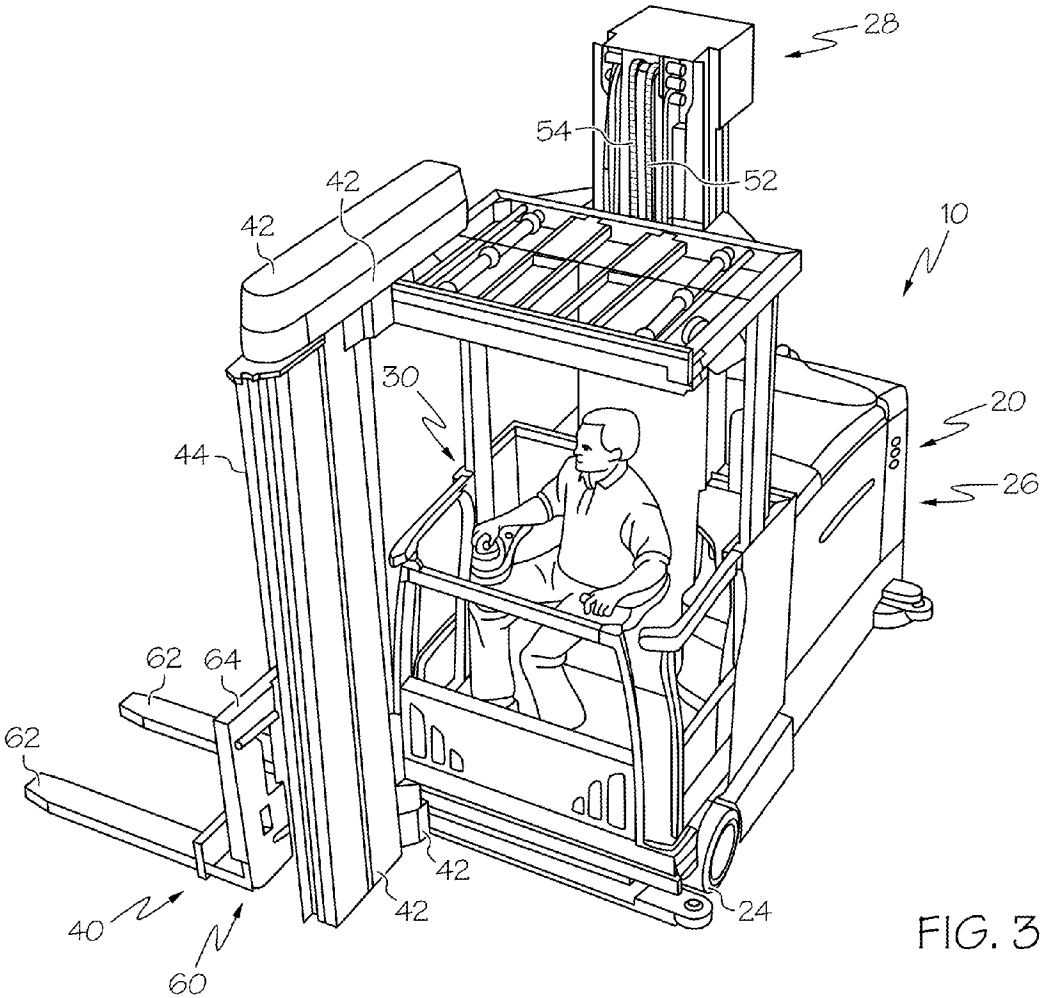
FIG. 3 is a perspective view of the vehicle illustrated in FIG. 1 and with the fork assembly rotated 180° from the position of the fork assembly shown in FIG. 2.
Figure 7:
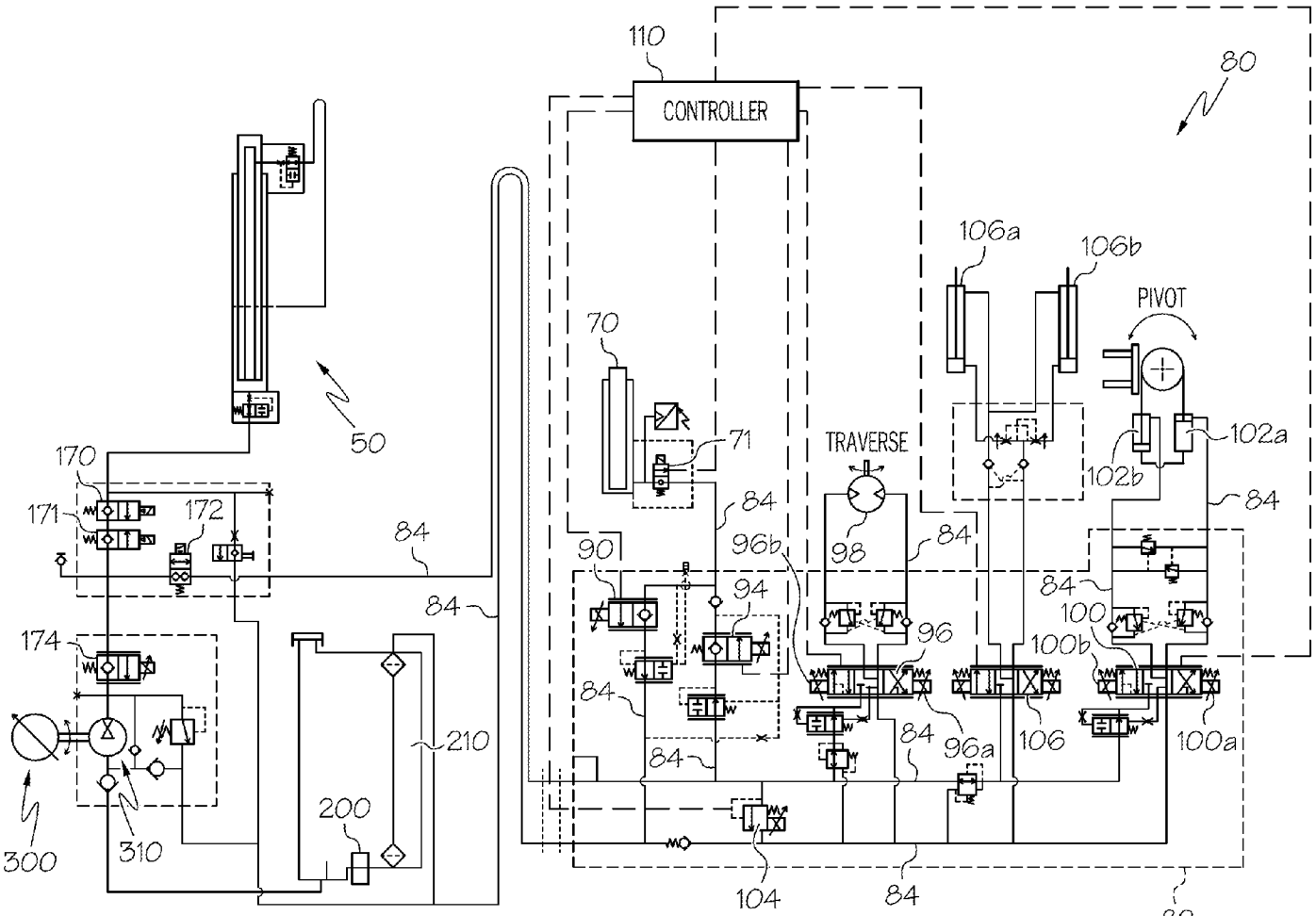
FIG. 7 illustrates a schematic diagram of a hydraulic circuit included in the vehicle of FIG. 1.

The load handling assembly 40 comprises a first structure 42, which is movable back and forth transversely relative to the platform assembly 30, as designated by an arrow 200 in FIG. 2, via a traverse hydraulic motor 98, see also FIGS. 3, 4 and 7. The load handling assembly 40 further comprises a second structure 44 (also referred to herein as an auxiliary mast assembly), which moves transversely with the first structure 42 and is also capable of rotating relative to the first structure 42 via first and second pivot piston/cylinder units 102*a* and 102*b*. In the illustrated embodiment, the second structure 44 is capable of rotating back and forth through an angle of about 180°. Coupled to the second structure 44 is a fork carriage assembly 60 (also referred to herein as a second carriage assembly) comprising a pair of forks 62 and a fork support 64. The fork carriage assembly 60 is capable of moving vertically relative to the second structure 44, as designated by an arrow 203 in FIG. 1. Rotation of the second structure 44 relative to the first structure 42 permits an operator to position the forks 62 in one of at least a first position, illustrated in FIGS. 1, 2 and 4, and a second position, illustrated in FIG. 3, where the second structure 44 has been rotated through an angle of about 180° from its position shown in FIGS. 1, 2 and 4.

In one embodiment, shown only in FIG. 2, the forks 62 comprise a first fork assembly 160 and a second fork assembly 162. The first fork assembly 160 comprises a first fork member 160A fixed to the fork support 64 and a second fork member 160B movable relative to the first fork member 160A via a first extension piston/cylinder unit 106*a*, see FIG. 7, coupled between the first and second fork members 160A and 160B. The second fork assembly 162 comprises a third fork member 162A fixed to the fork support 64 and a fourth fork member 162B movable relative to the third fork member 162A via a second extension piston/cylinder unit 106*b*, see FIG. 7, coupled between the third and fourth fork members 162A and 162B. When the first and second extension piston/cylinder units 106*a* and 106*b* are actuated so as to extend their pistons, the second and fourth fork members 160B and 162B move away from, i.e., extend out from, the first and third fork members 160A and 162A so as to define extended forks.

Figure 6:
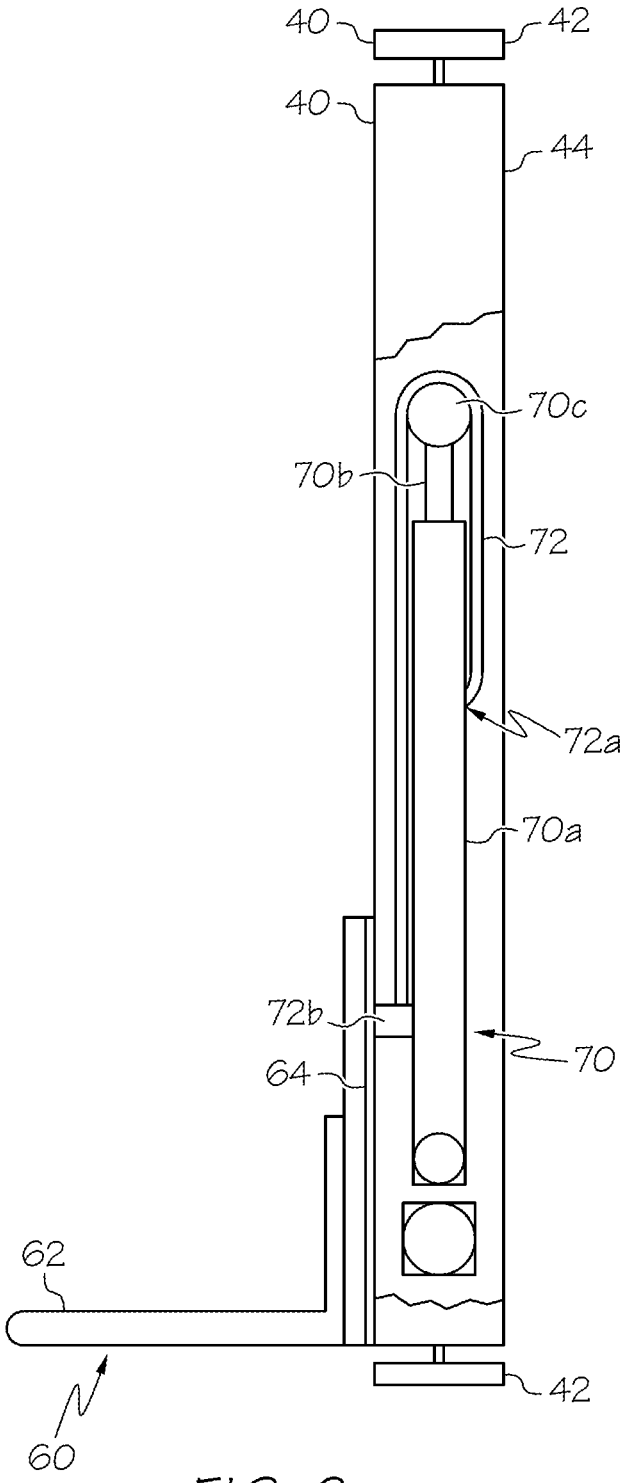
FIG. 6 is a schematic view illustrating the fork carriage assembly lift piston/cylinder unit and electronically controlled valve coupled to the fork carriage assembly lift piston/cylinder unit of the vehicle illustrated in FIG. 1.

A piston/cylinder unit 70 (also referred to herein as an "auxiliary hoist piston/cylinder unit") is provided in the second structure 44 for effecting vertical movement of the fork carriage assembly 60 relative to the second structure 44, see FIG. 6. The cylinder 70*a* forming part of the piston/cylinder unit 70 is fixedly coupled to the second structure 44. The piston or ram 70*b* forming part of the unit 70 comprises a pulley 70*c* on its distal end, which engages a chain 72. One unit of vertical movement of the piston 70*b* results in two units of vertical movement of the fork carriage assembly 60. The chain 72 is fixedly coupled at a first end 72*a* to the cylinder 70*a* and fixedly coupled at a second end 72*b* to the fork support 64. The chain 72 extends from the cylinder 70*a*, over the pulley 70*c* and down to the fork support 64. Upward movement of the piston 70*b* effects upward movement of the fork carriage assembly 60 relative to the second structure 44, while downward movement of the piston 70*b* effects downward movement of the fork carriage assembly 60 relative to the second structure 44.

A schematic diagram of a hydraulic circuit 80 of the vehicle 10 is illustrated in FIG. 7. The hydraulic circuit 80 in the embodiment shown comprises a manifold 82 located in an upper portion 42A of the first structure 42 of the load handling assembly 40.

Flow path defining conduits or hoses 84 enable working fluid communication between the valves and pumps, cylinders, and motors associated with the hydraulic circuit 80. Provided in the manifold 82 are a plurality of mechanical and electronically controlled valves that receive the working fluid, e.g., a pressurized hydraulic oil, during normal operation of the vehicle 10, e.g., when the components of the vehicle are fully operational. The electronically controlled valves of the manifold 82 may comprise electronically controlled solenoid-operated proportional valves, coupled to and actuated by a controller 110 in response to operator generated commands via first and second multi-function controllers 120A and 120B, and are provided for implementing various vehicle functions associated with the respective valve.

Exemplary valves in the illustrated manifold 82 include an auxiliary lower valve 90 that controls the flow of the working fluid out of the auxiliary hoist piston/cylinder unit 70 when a lowering command is being implemented; an auxiliary raise valve 94 that controls the flow of the working fluid into the auxiliary hoist piston/cylinder unit 70 when a raise command is being implemented; a traverse valve 96 that controls the flow of the working fluid to and/or from the traverse hydraulic motor 98 when a traverse command is being implemented; a pivot valve 100 that controls the flow of the working fluid to and/or from the first and second pivot piston/cylinder units 102*a*, 102*b* when a pivot command is being implemented; and an extend valve 106 that controls the flow of the working fluid to and/or from the first and second extension piston/cylinder units 106*a* and 106*b* when a second/fourth fork member extension/retraction command is being implemented. A load handler valve 104 is also provided in the manifold 82. The valve 104 controls a pressure level within the hydraulic manifold 82 such that the hydraulic fluid pressure downstream from the valve 104 is at a sufficient level for proper operation of a selected one or more of the electronically controlled solenoid valves 94, 96, 100, 106. Prior to installation, each of the valves 90, 94, 96, 100, 104 and 106 is initially charged with an ISO32 hydraulic oil or similar oil within a casing or housing of the respective valve. After installation and during normal operation of each of the valves 90, 94, 96, 100, 104 and 106, working fluid, i.e., pressurized hydraulic oil, moving through each valve may come in contact with the ISO32 oil. However, some amount of the ISO32 oil typically remains in each valve and defines a residue oil, even after each valve has been in operation for significant periods of time. The residue oil also functions, either alone or in combination with the working hydraulic fluid flowing through the valve, as an internal lubrication oil for the valve. The ISO32 oil is not a low temperature oil; hence, at low temperatures, it becomes viscous. The working fluid may comprise a low temperature hydraulic oil.

In the illustrated embodiment, the auxiliary lower valve 90 may comprise a solenoid-operated, two-way, normally closed, proportional directional valve; the auxiliary raise valve 94 may comprise a solenoid-operated, two-way, normally closed, proportional directional valve; the traverse valve 96 may comprise a solenoid-operated, 5-way, 3-position, proportional directional, load sensing valve; the pivot valve 100 may comprise a solenoid-operated, 5-way, 3-position, proportional directional, load sensing valve; the extend valve 106 may comprise a solenoid-operated, 4-way, 3-position, proportional directional motor spool valve; the load handler valve 104 may comprise a solenoid-operated, proportional pressure control relief valve.

As noted above, the initial charge of oil within the electronically controlled solenoid-operated proportional valves 90, 94, 96, 100, 104, 106 may be ISO32 hydraulic oil and not a low-temperature oil, or other oil that is not a low-temperature oil. It has been found that the performance of these electronically controlled valves 90, 94, 96, 100, 104, 106 in the manifold 82 may be less than optimal, i.e., the solenoid-controlled armature within each valve may not move properly to open and close the valve, if the residue oil within the respective valve is too cold. This situation is especially evident in situations where the vehicle 10 is stored in a cold environment, such as an industrial warehouse freezer, for an extended period of time during shut down. These valves have been found to perform in a degraded manner until the residue oil located within the valves is warmed to a temperature wherein the oil is no longer in a high viscosity state, i.e., caused by the oil being too cold. A method of warming these valves such that the residue oil therein is in a lower viscosity state according to an aspect of the invention will now be described.

Figure 8:
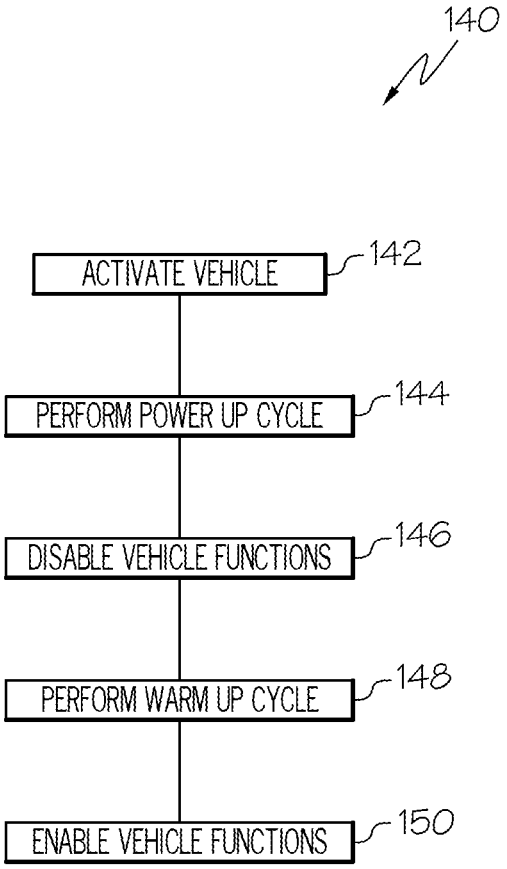
FIG. 8 is a flow chart illustrating process steps implemented by a controller in accordance with one embodiment of the present invention.

Referring to FIG. 8, a method 140 for warming residue oil in one or more valves comprises activating the vehicle 10 at step 142, which may comprise powering on, i.e., activating, the vehicle 10. The method 140 may be implemented by the controller 110.

The vehicle 10 then performs a power up cycle at step 144, which comprises verifying the operability of at least one vehicle component, and also may include checking a temperature of the working fluid, i.e., the working fluid that is circulated within the hydraulic circuit 80 during normal operation of the vehicle 10, as discussed above. For example, a temperature sensor 200 may be provided in a hydraulic fluid reservoir 210 of the hydraulic circuit 80.

After the power up cycle 144, if the temperature of the working fluid in the hydraulic fluid reservoir 210 is below a threshold temperature, then the operator may be prompted on a vehicle display to run a warm up cycle. According to one aspect of the invention, the warm up cycle may only be performed if certain conditions are met. As a first example, the warm up cycle may only be performed if the temperature of the working fluid, as measured during the power up cycle at step 144, is determined to be below a threshold temperature, which may be lower than from about 0° Celsius to about −15° Celsius and preferably comprises about −10° Celsius. As a second example, the warm up cycle may only be performed if an operator so chooses. For example, after the power up cycle is complete at step 144, the operator may be prompted to perform a warm up cycle, and the vehicle 10 may only perform the warm up cycle if the operator responds in the affirmative. It is noted that these options, i.e., examples 1 and 2, could be practiced either exclusively or concurrently, but example 1 is preferable to avoid performing a warm up cycle if the residue oil within the valves is warm enough such that it is not in a sludge-like state.

If the operator activates the warm up cycle, then one or more vehicle functions may be disabled at step 146. For example, vehicle traction may be disabled, a pump motor 300 that drives a pump 310, see FIG. 7, effecting movement of the working fluid through the hydraulic circuit 80 during normal operation of the vehicle 10 may be disabled, etc.

The vehicle may then perform a warm up cycle at step 148 after the one or more vehicle functions are disabled. In the illustrated embodiment, the warm up cycle comprises providing energy, e.g., electric current, to at least one valve within the manifold 82 so as to energize the valve without providing working fluid to the valve. Providing energy to the at least one valve effects a heating of the residue oil within the at least one valve, e.g., so as to transition the residue oil from a high viscosity sludge-like state in the case that the residue oil is too cold. In the illustrated embodiment, so as to reduce power usage, energy is provided to only the auxiliary lower valve 90, the auxiliary raise valve 94, the traverse valve 96, the pivot valve 100, and the load handler valve 104 during the warm up cycle, although energy could also be provided to the extend valve 106 within the manifold 82. It is noted that the traverse valve 96 and the pivot valve 100 illustrated in FIG. 7 each comprise first and second coils 96*a*, 96*b* and 100*a*, 100*b*. Either or both of these coils 96*a*, 96*b* and 100*a*, 100*b* could be energized during the warm up cycle, but preferably only one of the traverse valve coils 96*a*, 96*b* is heated and only one of the pivot valve coils 100*a*, 100*b* is heated, so as to conserve energy.

Energy may be provided to the valves during the warm up cycle for a predetermined time period, e.g., for about 3 to about 5 minutes, wherein the predetermined time period may vary depending upon an initial temperature of the working fluid as measured during the power up cycle at step 144 or may be fixed for any initial temperature of the working fluid measured during the power up cycle. In one embodiment, energy may be selectively provided to the individual valves for valve-specific time periods. For example, energy may be provided to one or more of the valves for a first time period, to one or more others of the valves for a second time period, etc. Additionally, a time remaining until completion of the warm up cycle may be displayed on a display (not shown) of the vehicle 10. As an alternative to performing the warm up cycle for a predetermined time period, the warm up cycle may be performed for as long as it takes for the residue oil located within the valves to reach a predetermined temperature, i.e., a temperature at which the oil is no longer in a sludge-like state.

Once the warm up cycle is complete, the one or more vehicle functions that were disabled during step 146 are enabled at step 150.

In accordance with one aspect of the invention, the vehicle 10 may only allow a predetermined number of warm up cycles to be performed in a given time interval. For example, the vehicle 10 may only permit two warm up cycles to be performed within a half hour time interval. This will reduce energy drainage on the energy/power source that supplies the energy to the valves, which energy source may comprise a 48 volt supply that also services one or more other vehicle functions, such as a seat repositioning function. In this regard, a warm up cycle may be considered to be performed if the warm up cycle is performed for a least a predefined portion of the predetermined time period, such as for about 1 minute of the 3-5 minute time period.

The hydraulic circuit 80 comprises other electronically controlled solenoid-operated valves mounted in the power unit 20. For example, an electronically controlled solenoid-operated non-proportional valve 170 is provided for blocking fluid flow out of the mast piston/cylinder unit 50 until the valve 170 is energized. An electronically controlled solenoid-operated non-proportional valve 171 is provided for blocking working fluid to the mast piston/cylinder unit 50 when not energized and allows fluid flow to the mast piston/cylinder unit 50 when the valve 171 is energized. An electronically controlled solenoid-operated non-proportional valve 172 is provided for blocking working fluid flow to the manifold 82 if working fluid is being provided to or exiting the mast piston/cylinder unit 50 and allows working fluid flow to the manifold 82 when the valve 172 is energized. An electronically controlled solenoid-operated proportional valve 174 is provided and functions as a load holding valve for the mast piston/cylinder unit 50 and must be energized when the mast piston/cylinder unit 50 is lowered such that the working fluid flows through the valve 174 back through the pump 310. It is also contemplated that, depending upon power availability and whether one or more of these valves performs poorly when cold, one or more of the electronically controlled solenoid-operated valves mounted within the power unit 20 may be energized during the warm up cycle.

An electronically controlled solenoid-operated, normally closed, proportional valve 71 is coupled to a base of the cylinder 70*a* of the auxiliary hoist piston/cylinder unit 70 and is energized by the controller 110 during a controlled descent of the piston 70*b* of the unit 70. The valve 71 is deactivated by the controller 110, i.e., power is no longer provided to the valve 71 such that it closes, if the rate of descent of the fork carriage assembly 60 relative to the second structure 44 exceeds a predefined threshold, such as 80 feet/min. The valve 71 may also be energized during a warm-up cycle in accordance with the present invention.

In accordance with a further embodiment of the present invention, instead of checking a temperature of the working fluid, i.e., the working fluid that is circulated within the hydraulic circuit 80 during normal operation of the vehicle 10, as discussed above, the warm-up cycle for one or more valves may be activated if the temperature of a valve is determined to be below a first predetermined temperature, e.g., 10 degrees C. For example, the controller 110 may continuously or periodically cause 1 A of current to pass through a coil of the valve 71 coupled to the base of the cylinder 70*a*. The voltage across the coil within the valve 71 is then detected. The resistance of the coil within the valve 71 is then determined by the controller 110 based on the measured voltage and the 1 A of current passed through the valve coil. Valve coil resistance varies with temperature. A look-up table or algorithm providing temperature as an output based on resistance as an input is stored in memory, which the controller 110 accesses to determine the temperature of the valve 71 using the determined resistance of the valve coil. If the temperature of the valve 71 is less than the first predetermined temperature, e.g., 10 degrees C., then the warm up cycle is activated for the valve 71 and continues until the temperature of the valve 71 increases above a second predetermined temperature, e.g., 40 degrees C., at which point the warm up cycle is turned off. It is also contemplated that the warm up cycle may be initiated when the temperature of the valve 71 drops below the first predetermined temperature and continues for a predefined time period without the need to determine if the valve temperature has increased above the second predetermined temperature. The temperature of the valve 71 may be continuously monitored by the controller 110 during the entire operation of the vehicle, not just after a power up cycle of the vehicle has been completed. In an alternative embodiment, the warm up cycle may only be performed if the following two conditions are met: the temperature of the valve 71 is less than the first predetermined temperature and an operator initiates a command to have the warm up cycle performed.

The valve warm up system of the present invention may also be incorporated into other materials handling vehicles, such as vehicles having a base unit, a conventional mast assembly comprising a fixed mast weldment coupled to the base unit and one or two movable mast weldments, and a fork carriage assembly movably coupled to the mast assembly. An example of such a vehicle is disclosed in U.S. Patent Application Publication No. 2007/0205056, the entire disclosure of which is incorporated herein by reference. Any one of the electronically controlled valves provided in the truck illustrated in U.S. Patent Application Publication No. 2007/0205056 may be energized during a warm up cycle. It may be preferred, for example, to energize one or more of the electronically controlled solenoid-operated valves provided in the manifold apparatus 500 mounted to the mast assembly 100, particularly any electronically controlled solenoid-operated proportional valves.

It is also contemplated that an electronically controlled solenoid-operated normally closed, proportional valve coupled to a base of a piston/cylinder unit for effecting movement of one or more movable mast weldments relative to a fixed mast weldment or a fork carriage assembly relative to a mast assembly or a load handling assembly may be deactivated by a controller if a rate of descent of the one or more movable mast weldments relative to the fixed mast weldment or the fork carriage assembly relative to the mast assembly exceeds an operator commanded speed or an operator commanded speed and a threshold speed, as set out in U.S. Pat. No. 7,344,000, the entire disclosure of which is incorporated by reference herein. The electronically controlled solenoid-operated proportional valve coupled to the base of the piston/cylinder unit may be energized during a warm up cycle in accordance with the present invention.

It is also contemplated that an electronically controlled solenoid-operated, normally closed, proportional valve coupled to a base of piston/cylinder unit for effecting movement of one or more movable mast weldments relative to a fixed mast weldment or a fork carriage assembly relative to a mast assembly may be deactivated by a controller if a rate of descent of the one or more movable mast weldments relative to the fixed mast weldment or the fork carriage assembly relative to the mast assembly exceeds: 1) a first threshold speed estimated from a lift motor speed or 2) exceeds either the first threshold speed estimated from the lift motor speed or a fixed, second threshold speed, as set out in U.S. Patent Application Publication No. 2012/0209478, the entire disclosure of which is incorporated herein by reference. The electronically controlled solenoid-operated proportional valve coupled to the base of the piston/cylinder unit may be energized during a warm up cycle in accordance with the present invention. It is also contemplated that an electronically controlled solenoid-operated proportional valve, if used to control movement of one or more reach cylinders of a reach mechanism forming part of a fork carriage assembly, may be energized during a warm up cycle.

The valve warm up system of the present invention may further be incorporated into a materials handling vehicles having a monomast assembly, such as disclosed in U.S. Patent Application Publication No. 2010/0065377 or U.S. Patent Application No. 2012/0209478, the entire disclosure of which is incorporated herein by reference. Any one of the electronically controlled valves provided on the truck illustrated in U.S. Patent Application Publication No. 2010/0065377 or U.S. Patent Application No. 2012/0209478 may be energized during a warm up cycle.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for operating a materials handling vehicle comprising:

activating the materials handling vehicle; and performing a warm up cycle comprising providing energy to at least one valve within the materials handling vehicle so as to energize the at least one valve without providing a working fluid to the at least one valve, wherein providing energy to the at least one valve comprises providing electric current to the at least one valve and effects a heating of oil located within the at least one valve.

2. The method as set out in claim 1, further comprising performing a power up cycle after activating the materials handling vehicle and before performing the warm up cycle, wherein the power up cycle comprises verifying the operability of at least one vehicle component.

3. The method as set out in claim 1, wherein the oil comprises a residue oil for the at least one valve.

4. The method as set out in claim 3, further comprising checking a temperature of the working fluid, the working fluid comprising a hydraulic fluid that is circulated within a hydraulic fluid circuit including the at least one valve for implementing one or more vehicle functions associated with the at least one valve.

5. The method as set out in claim 4, where the energy is only provided to the at least one valve if the temperature of the working fluid is determined to be below a threshold temperature.

6. The method as set out in claim 5, wherein the threshold temperature is equal to or less than about −10° Celsius.

7. The method as set out in claim 1, further comprising prompting an operator if the warm up cycle is to be performed and only performing the warm up cycle if the operator responds in the affirmative.

8. The method as set out in claim 1, further comprising disabling one or more vehicle functions prior to the warm up cycle.

9. The method as set out in claim 8, further comprising enabling the one or more vehicle functions upon completion of the warm up cycle.

10. The method as set out in claim 1, wherein the at least one valve comprises one of a solenoid-operated proportional valve and a solenoid-operated non-proportional valve.

11. The method as set out in claim 10, wherein the materials handling vehicle comprises a base unit, a mast assembly coupled to the base unit, and a carriage assembly coupled to the mast assembly for reciprocal movement along the mast assembly.

12. The method as set out in claim 11, wherein the carriage assembly comprises a fork carriage assembly.

13. The method as set out in claim 1, wherein providing energy to at least one valve comprises providing energy to at least one of the following:

an auxiliary lower valve that controls the flow of the working fluid out of an auxiliary hoist piston/cylinder unit when a lowering command is being implemented;

an auxiliary raise valve that controls the flow of the working fluid into the auxiliary hoist piston/cylinder unit when a raise command is being implemented;

a traverse valve that controls the flow of the working fluid to and/or from a traverse motor when a traverse command is being implemented;

a pivot valve that controls the flow of the working fluid to and/or from one or more pivot piston/cylinder units when a pivot command is being implemented; and a load handler valve that controls a pressure level within a hydraulic circuit in which the working fluid flows.

14. The method as set out in claim 1, wherein providing energy to at least one valve comprises providing energy to each of the following:

an auxiliary lower valve that controls the flow of the working fluid out of an auxiliary hoist piston/cylinder unit when a lowering command is being implemented;

an auxiliary raise valve that controls the flow of the working fluid into the auxiliary hoist piston/cylinder unit when a raise command is being implemented;

a traverse valve that controls the flow of the working fluid to and/or from a traverse motor when a traverse command is being implemented;

a pivot valve that controls the flow of the working fluid to and/or from one or more pivot piston/cylinder units when a pivot command is being implemented; and a load handler valve that controls a pressure level within a hydraulic circuit in which the working fluid flows.

15. The method as set out in claim 14, wherein energy can be selectively provided to each of the individual valves for a valve-specific time period.

16. The method as set out in claim 1, wherein the energy is provided to the at least one valve during the warm up cycle for a predetermined time period.

17. The method as set out in claim 16, wherein the predetermined time period is from about three to about five minutes.

18. The method as set out in claim 16, further comprising displaying a time remaining until completion of the warm up cycle on a display of the materials handling vehicle.

19. The method as set out in claim 16, wherein the predetermined time period varies according to a determined initial temperature of the working fluid.

20. The method as set out in claim 1, wherein only a predetermined number of warm up cycles are permitted to be performed by the materials handling vehicle in a given time interval.

21. The method as set out in claim 20, wherein two warm up cycles can be performed by the materials handling vehicle during every half hour time interval.

22. The method as set out in claim 20, wherein:

energy is provided to the at least one valve during the warm up cycle for a predetermined time period; and a warm up cycle is considered to be performed if the warm up cycle is performed for a least a predefined portion of the predetermined time period.

23. The method as set out in claim 1, further comprising determining a temperature of the at least one valve and wherein the energy is only provided to the at least one valve if the temperature of the valve is determined to be below a threshold temperature.

24. A method for operating a materials handling vehicle comprising:

providing the materials handling vehicle comprising:

a base unit;

a mast assembly coupled to the base unit;

a carriage assembly coupled to the mast assembly for reciprocal movement along the mast assembly; and a hydraulic fluid circuit including at least one valve for implementing one or more vehicle functions;

activating the materials handling vehicle; and performing a warm up cycle comprising providing energy to the at least one valve so as to energize the at least one valve, wherein providing energy to the at least one valve comprises providing electric current to the at least one valve and effects a heating of residue oil located within the at least one valve.

25. The method as set out in claim 24, wherein the carriage assembly comprises a fork carriage assembly.

26. The method as set out in claim 24, further comprising checking a temperature of a working fluid, the working fluid comprising a hydraulic fluid that is circulated during normal operation of the materials handling vehicle within the hydraulic fluid circuit.

27. The method as set out in claim 26, wherein the energy is only provided to the at least one valve if the temperature of the working fluid is determined to be below a threshold temperature.

28. The method as set out in claim 24, further comprising disabling a pump motor during the warm up cycle, the pump motor effecting movement of a working fluid through the at least one valve during normal operation of the materials handling vehicle.

29. The method as set out in claim 24, wherein the at least one valve comprises a solenoid-operated proportional valve.

30. A materials handling vehicle comprising:

a hydraulic fluid circuit including at least one valve for implementing one or more vehicle functions; and a controller for performing a warm up cycle comprising providing energy to the at least one valve so as to energize the at least one valve, wherein providing energy to the at least one valve comprises providing electric current to the at least one valve and effects a heating of residue oil located within the at least one valve.

31. The vehicle as set out in claim 30, further comprising:

a base unit;

a mast assembly coupled to the base unit; and a carriage assembly coupled to the mast assembly for reciprocal movement along the mast assembly.

32. The vehicle as set out in claim 31, wherein the carriage assembly comprises a fork carriage assembly.

33. The vehicle as set out in claim 30, wherein the controller determines a temperature of a working fluid, the working fluid comprising a hydraulic fluid that is circulated during normal operation of the materials handling vehicle within the hydraulic fluid circuit.

34. The vehicle as set out in claim 33, wherein the energy is only provided to the at least one valve if the temperature of the working fluid is determined to be below a threshold temperature.

35. The vehicle as set out in claim 30, wherein the controller disables a pump motor during the warm up cycle, the pump motor effecting movement of a working fluid through the at least one valve during normal operation of the materials handling vehicle.

36. The vehicle as set out in claim 30, wherein the at least one valve comprises a solenoid-operated proportional valve.

37. The vehicle as set out in claim 30, wherein the controller determines a temperature of the at least one valve and wherein the energy is only provided to the at least one valve if the temperature of the valve is determined to be below a threshold temperature.

* * * * *